US011123749B2

(12) United States Patent
Thakur et al.

(10) Patent No.: US 11,123,749 B2
(45) Date of Patent: Sep. 21, 2021

(54) SYSTEMS AND METHODS FOR SORTING MATERIAL ON A CONVEYOR

(71) Applicant: Novelis Inc., Atlanta, GA (US)

(72) Inventors: Adwait A. Thakur, Spokane Valley, WA (US); Michael R. Kosmicki, Spokane Valley, WA (US)

(73) Assignee: NOVELIS INC., Atlanta, GA (US)

( * ) Notice: Subject to any disclaimer, the term of this patent is extended or adjusted under 35 U.S.C. 154(b) by 248 days.

(21) Appl. No.: 16/504,797

(22) Filed: Jul. 8, 2019

(65) Prior Publication Data

US 2020/0009576 A1 Jan. 9, 2020

Related U.S. Application Data

(60) Provisional application No. 62/695,263, filed on Jul. 9, 2018.

(51) Int. Cl.
*B07C 5/36* (2006.01)
*B03C 1/23* (2006.01)
(Continued)

(52) U.S. Cl.
CPC ..... *B03C 1/23* (2013.01); *B03C 1/22* (2013.01); *B07C 5/342* (2013.01); *B07C 5/3416* (2013.01); *B07C 5/361* (2013.01); *B03C 2201/20* (2013.01)

(58) Field of Classification Search
CPC .... B03C 1/16; B03C 1/20; B03C 1/22; B03C 1/23; B03C 2201/20; B07C 5/3416; B07C 5/342; B07C 5/361; B07C 5/362
See application file for complete search history.

(56) References Cited

U.S. PATENT DOCUMENTS 3,382,977 A * 5/1968 Fraas ..... B03C 1/035 209/214
3,980,180 A 9/1976 Jamieson
(Continued)

FOREIGN PATENT DOCUMENTS

EP 0982083 A2 3/2000
WO 2016024043 A1 2/2016

OTHER PUBLICATIONS

International Patent Application No. PCT/US2019/040782 , Invitation to Pay Additional Fees and Partial International Search Report dated Oct. 4, 2019, 11 pages.
(Continued)

*Primary Examiner* — Joseph C Rodriguez
(74) *Attorney, Agent, or Firm* — Kilpatrick Townsend & Stockton LLP

(57) ABSTRACT

Disclosed are systems and methods for sorting material on a conveyor of a conveyor system, such as a conveyor system for material including non-ferrous metals. The conveyor system includes a conveyor belt and a separator system. The conveyor belt is adapted to convey the material. The separator system includes a separator below the conveyor belt and is configured to selectively apply a separating force onto the material on the conveyor belt such that at least one piece of the material is lifted off of the conveyor belt. A method of sorting material on a conveyor belt includes receiving the material on the conveyor belt, conveying the material with the conveyor belt, and applying the separating force onto the material with the separator such that at least one piece of the material is lifted off of the conveyor belt.

18 Claims, 9 Drawing Sheets

(51) Int. Cl.

| | |
|---|---|
| ***B03C 1/22*** | (2006.01) |
| ***B07C 5/34*** | (2006.01) |
| ***B07C 5/342*** | (2006.01) |

(56) References Cited

U.S. PATENT DOCUMENTS

| | | | | |
|---|---|---|---|---|
| 4,743,364 | A * | 5/1988 | Kyrazis | B03C 1/23 209/212 |
| 5,823,354 | A * | 10/1998 | Elkind | B03C 1/23 209/212 |
| 6,313,422 | B1 * | 11/2001 | Anibas | B07C 5/362 198/370.11 |
| 7,775,369 | B2 * | 8/2010 | Cowling | B07C 5/36 209/44.2 |
| 8,158,902 | B2 * | 4/2012 | Valerio | B07C 5/344 209/571 |
| 9,221,061 | B2 * | 12/2015 | Rem | B03C 1/30 |
| 10,836,584 | B2 * | 11/2020 | Kosmicki | B03C 1/0332 |
| 2017/0014868 | A1 | 1/2017 | Garcia et al. | |

OTHER PUBLICATIONS

International Patent Application No. PCT/US2019/040782 , International Search Report and Written Opinion dated Nov. 25, 2019, 16 pages.

Indian Patent Application No. 202017056629 , First Examination Report dated May 12, 2021, 6 pages.

* cited by examiner

SYSTEMS AND METHODS FOR SORTING MATERIAL ON A CONVEYOR

REFERENCE TO RELATED APPLICATION

This application claims the benefit of U.S. Provisional Application No. 62/695,263, filed on Jul. 9, 2018 and titled SYSTEMS AND METHODS FOR SORTING MATERIAL ON A CONVEYOR, the content of which is hereby incorporated by reference in its entirety.

FIELD OF THE INVENTION

This application relates to conveyor belts configured to carry mixed materials, and more particularly to systems and methods for sorting material on the conveyor belts.

BACKGROUND

Conveyor belts are used in a number of industries for conveying different kinds of material. Oftentimes, the material is mixed material that must be sorted before it can be further processed. For example, during recycling, metal material is commonly separated from organic or non-metal material. After separating from the non-metal material, the metal material is commonly further separated and sorted into various classifications of metal. Traditional separator systems are limited in that they can only sort and classify material into two classifications due to mechanical limitations. Alternatively, to classify and sort material into more than two classifications, the material must be arranged in a single stream of items, which drastically reduces the throughput of the overall system and may be difficult to implement at certain locations along the conveyor belt. If multiple pieces of material are on the belt in such scenarios, mechanical techniques such as robotic arms, humans, etc. may not be practically possible because the belt speed is high and there will be a decrease in efficiency.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to various examples, a conveyor system includes a conveyor belt and a separator system. The conveyor belt includes a conveying surface, and the conveyor belt is adapted to convey material on the conveying surface. The separator system includes a separator below the conveying surface, and the separator is configured to selectively apply a separating force onto the material on the conveyor belt such that at least one piece of the material is lifted off of the conveying surface.

In various examples, the separating force is selectively applied. In some aspects, the conveyor system includes a first roller and a second roller downstream from the first roller. In certain cases, the conveyor belt is movably supported on the first roller and the second roller, and the second roller is at an end of the conveyor belt. In various examples, the separator is between the first roller and the second roller. In certain examples, the separator is downstream from the conveyor belt and is adjacent to the end of the conveyor belt. In various examples, the conveyor system includes more than two rollers.

In certain examples, the separator is configured to apply the separating force onto non-ferrous metals of the material. In various aspects, the conveyor belt is porous.

According to certain examples, the separator system include a sensor and a controller communicatively connected to the sensor and the separator. In various aspects, the sensor is adapted to detect at least one piece of material of the material on the conveyor belt, the controller is adapted to classify the detected piece of material into a predefined classification, and the controller is adapted to selectively control the separating force from the separator based on the classification of the detected piece of material. In some cases, the sensor includes at least one of a laser-induced breakdown spectroscopy sensor, an x-ray fluorescence sensor, a near-infrared spectroscopy sensor, and/or any non-destructive sensor technique or method.

In various aspects, the separator is adapted to apply the separating force onto the material on the conveyor belt such that at least some of the material is lifted off of the conveying surface and in a direction substantially parallel to a conveying direction. In some cases, the separator is adapted to apply the separating force onto the material on the conveyor belt such that at least some of the material is lifted off of the conveying surface and in a direction transverse to a conveying direction. According to some examples, the separator is adapted to apply the separating force onto the material on the conveyor belt such that at least some of the material is lifted off of the conveying surface to a separated distance. In various examples, the separated distance is from about 1 inch to about 12 inches.

In some examples, the separator includes an electromagnet, and the separating force is a magnetic field applied by the electromagnet. In certain cases, the electromagnet is adjustable such that the magnetic field is adjustable. In some aspects, at least one of a strength of the magnetic field, a frequency of the magnetic field, or an angle of a central axis of the electromagnet with respect to the conveying surface are adjustable. In certain cases, the magnetic field is a changing magnetic field.

According to various examples, the separator includes a plurality of magnets, including but not limited to electromagnets, and the separating force is a magnetic field applied by each of the plurality of electromagnets. In certain cases, the magnetic field is a changing magnetic field. In various cases, each of the plurality of electromagnets of the separator is independently controllable. In certain cases, the separator includes a first region having a first subset of the plurality of electromagnets and a second region having a second subset of the plurality of electromagnets, and the magnetic field generated by at least one of the electromagnets of the first subset is different from the magnetic field generated by at least one of the electromagnets of the second subset. In various aspects, a sensor is upstream from the separator, and a controller is communicatively connected to the sensor and the separator. In various examples, the sensor is adapted to detect at least one piece of material of the material on the conveyor belt, the controller is adapted to classify the detected piece of material into a predefined classification, and the controller is adapted to selectively control the separating force from at least one of the electromagnets of the separator based on the classification of the detected piece of material. In certain cases, the separator system includes a sensor configured to detect a position of at least one non-ferrous piece of metal of the material on the conveying surface, and the controller is configured to control the separator based on the position of the at least one non-ferrous piece of metal on the conveying surface.

In some aspects, the separator includes a plurality of air nozzles arranged below the conveying surface, and the separating force is airflow from each of the plurality of air nozzles.

In various aspects, the separator is a primary separator, and the separator system includes a secondary separator configured to apply a sorting force on the material lifted off of the conveying surface by the separating force. In various examples, the secondary separator is above the conveying surface. In some examples, the secondary separator includes at least one vacuum, and the separating force is a vacuum force. In certain cases, the secondary separator includes at least one air nozzle, and the separating force is airflow from the at least one nozzle. In certain examples, the secondary separator includes a second conveyor belt having a second conveying surface, at least one electromagnet beneath the second conveying surface, and a copper plate between the at least one electromagnet and the second conveying surface. According to certain examples, the separating force is a magnetic field from the at least one electromagnet and the copper plate. In certain cases, the magnetic field is a changing magnetic field. In certain cases, the second conveyor extends transversely to the conveyor. In various aspects, the second conveying surface faces the conveying surface. In some cases, the secondary separator is adapted to apply the sorting force in a direction transverse to a conveying direction. In certain examples, the conveyor belt is a first conveyor belt, the conveying system includes a second conveyor belt, and the separator is configured to selectively apply the separating force onto the material on the conveyor belt such that at least one piece of the material is lifted off of the conveying surface of the first conveyor belt and onto the second conveyor belt.

According to certain examples, a method of sorting material on a conveyor belt includes receiving the material on a conveying surface of the conveyor belt, conveying the material with the conveyor belt, and applying a separating force onto the material with a separator arranged below the conveying surface such that at least one piece of the material is lifted off of the conveying surface.

In some cases, at least some of the material includes non-ferrous metal, and the separating force is applied on the non-ferrous metal. In various cases, the separator includes at least one electromagnet, and the separating force includes a magnetic field. In some aspects, the method includes controlling the magnetic field by controlling at least one of a strength of the magnetic field, a frequency of the magnetic field, or a direction of the magnetic field. In certain cases, the magnetic field is a changing magnetic field.

In various examples, the method includes detecting a position of a non-ferrous metal of the material on the conveying surface before applying the separating force. In some aspects, applying the separating force includes applying the separating force at the position on the conveying surface corresponding to the detected position of the non-ferrous metal. In some cases, the separator is a primary separator, and the method includes applying a sorting force by a secondary separator on the material lifted off of the conveying surface by the separating force. According to various examples, the secondary separator is adapted to apply the sorting force in a direction transverse to a conveying direction.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing.

In this description, reference is made to alloys identified by AA numbers and other related designations, such as "series" or "5xxx," "6xxx," or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

Figure 1:
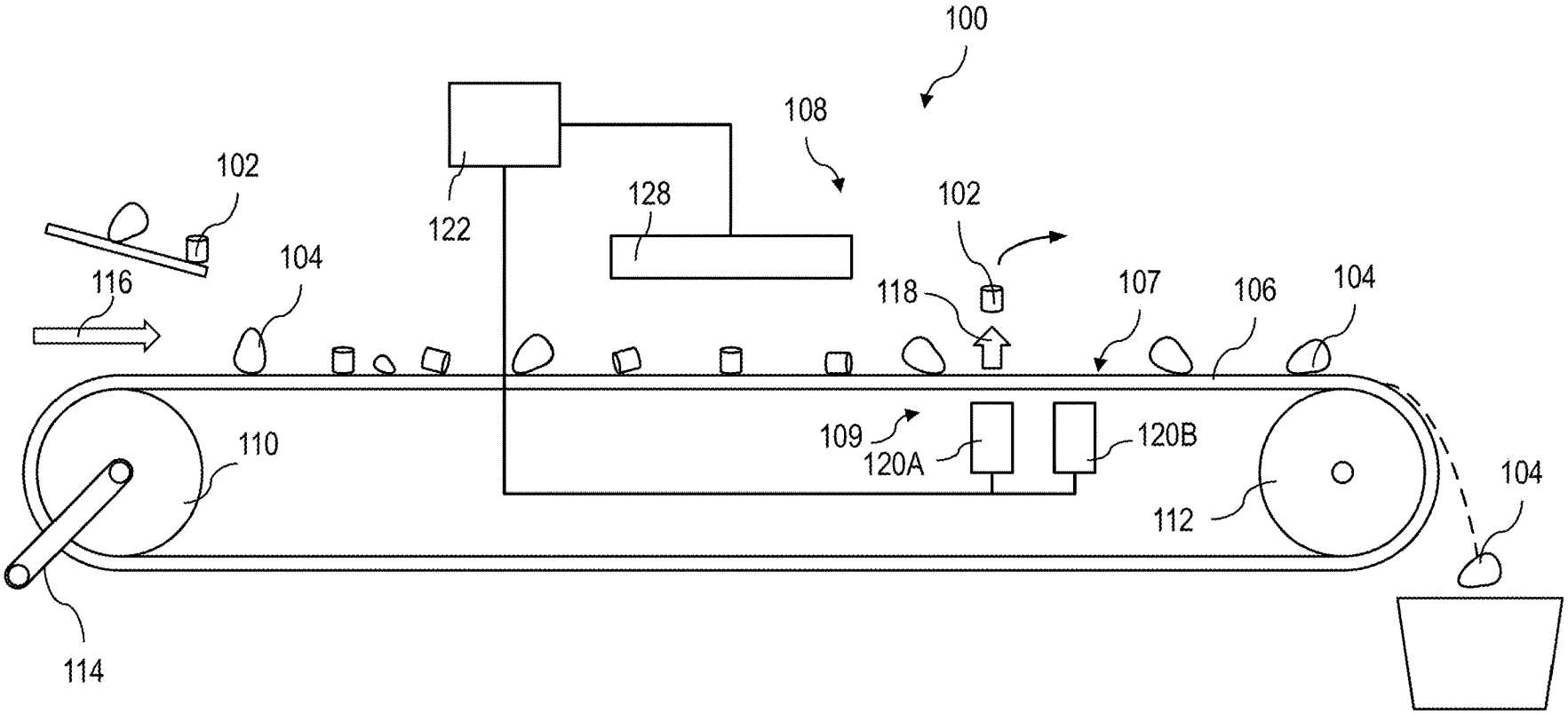
FIG. 1 is a side view of a conveyor system according to aspects of the current disclosure.

FIG. 1 illustrates an exemplary conveyor system 100 for conveying material, including but not limited to mixed material that contains metal materials 102 and non-metal materials 104. In the present example, the conveyor system 100 is a separator system for metal recycling such that non-ferrous metal materials 102 can be separated from the non-metal materials 104. However, it will be appreciated that the conveyor system 100 may be used in various other settings or environments, as well as on other types of materials or combinations of materials, as desired.

As illustrated in FIG. 1, the conveyor system 100 includes a conveyor belt 106 and a separator system 108. In some examples, the conveyor belt 106 is porous, although it need not be in other examples. The conveyor belt 106 has a conveying surface 107 and is movably supported on a first roller 110 and a second roller 112. In various examples, the first roller 110 is driven by a drive system 114 such that the conveyor belt 106 moves in the conveying direction indicated by arrow 116. The second roller 112 is an end roller or idler roller downstream from the first roller 110. In other examples, the second roller 112 may be driven by the drive system 114 to move the conveyor belt 106. In certain examples, the second roller 112 is downstream from the first roller 110. Although not illustrated, any number of intermediate roller may be provided between the first roller 110 and the second roller 112 and/or downstream from the first roller 110 depending on a desired length of the conveyor system 100.

In various examples, the material on the conveyor belt 106 is mixed material that includes various classifications of both metal material 102 and non-metal material 104 that are sorted into their predefined classifications before further processing. As one non-limiting example, the metal material 102 may include various types of aluminum alloys including, but not limited to, 1xxx series aluminum alloys, 2xxx series aluminum alloys, 3xxx series aluminum alloys, 4xxx series aluminum alloys, 5xxx series aluminum alloys 6xxx series aluminum alloys, 7xxx series aluminum alloys, and/or 8xxx series aluminum alloys, and/or various other types of metal materials 102. On the conveyor belt 106, the metal materials 102 may be mixed together and/or mixed with the various non-metal materials 104. As described below, the separator system 108 separates the mixed material into two or more predefined classifications such that the material can be further processed.

The separator system 108 includes a separator 109 and a sensor 128. The sensor 128 is configured to detect the material on the conveyor belt 106 and classify the material into a predefined classification. Based on the classification of the detected material, the separator 109 is configured to selectively apply a separating force (represented by arrow 118 in FIG. 1) onto the material on the conveyor belt 106 such that at least one piece of the material is lifted off of the conveying surface 107. In some examples, the separator 109 is also configured to eject the at least one piece of material from the conveyor belt 106.

In various examples, the separator 109 is between the first roller 110 and the second roller 112. In other examples, the separator 109 is upstream from the second roller 112 and is adjacent to an end of the conveyor belt 106 (see FIG. 9). In other examples, the separator 109 may be provided at various other locations relative to the roller 112 and/or conveyor belt 106 as desired. As discussed in detail below, in some cases, the separator 109 includes one or more magnets below the conveying surface 107, and the separating force 118 is a magnetic field. In certain cases, the magnetic field is a changing magnetic field. In other optional examples, the separator 109 is one or more airflow generators, such as air nozzles, below the conveying surface 107, and the separating force 118 is airflow generated by the one or more air nozzles. In such examples, the conveyor belt 106 may be porous, although it need not be as discussed above. Various combinations of types of separators may also be utilized. As one non-limiting example, the separator system 108 may include both a magnet and an airflow generator. Various other suitable separators and separating forces may be utilized.

Figure 2:
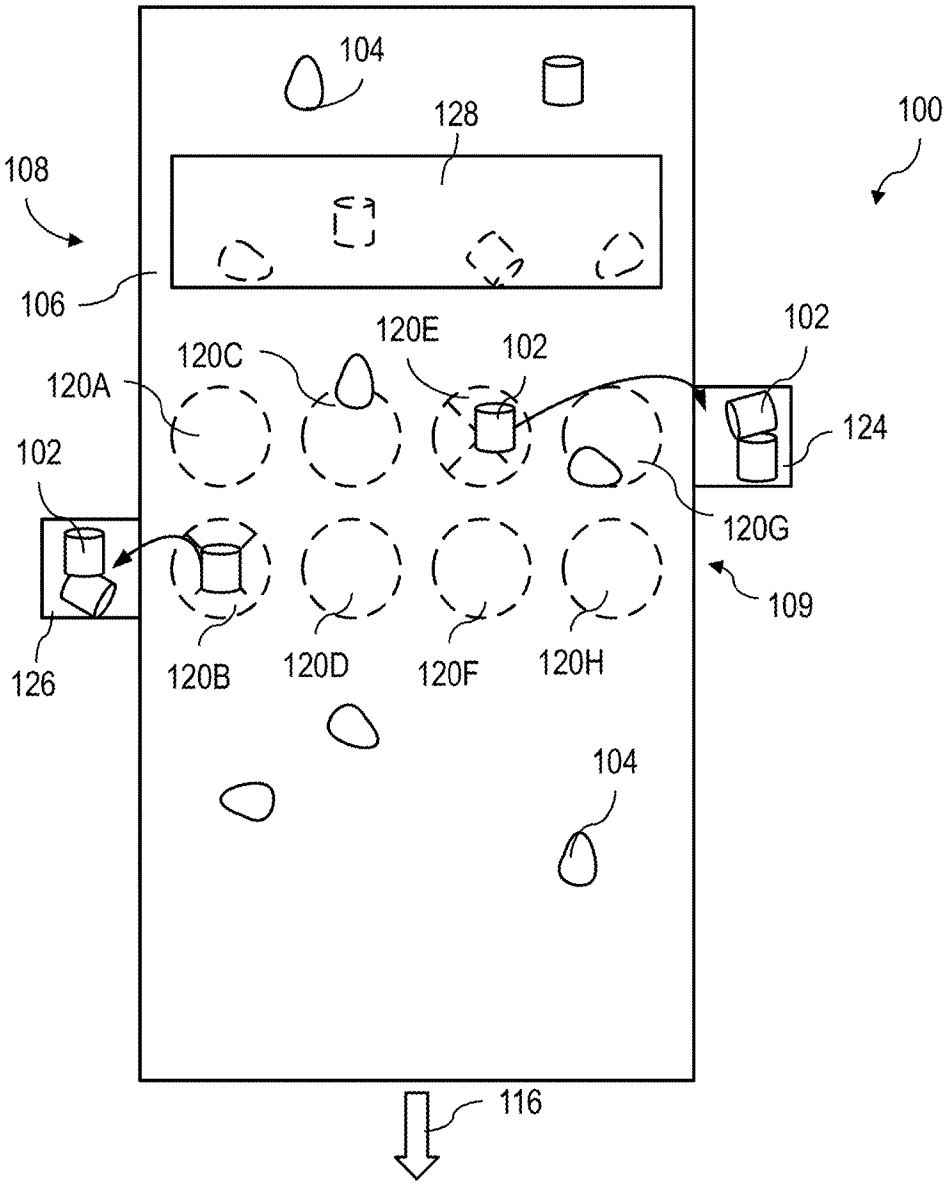
FIG. 2 is a top view of the conveyor system of FIG. 1.

Referring to FIGS. 1 and 2, in various examples, the sensor 128 is provided upstream from the separator 109. Optionally, the sensor 128 is communicatively connected to the separator 109 through a controller 122. In other examples, the sensor 128 and the separator 109 are directly communicatively connected. The sensor 128 (alone or in conjunction with the controller 122) is configured to detect the material on the conveying surface 107 of the conveyor belt 106 and to classify the detected material into a predefined category. As one non-limiting example, the sensor 128 is configured to detect the metal material 102 on the conveyor belt 106 and to classify the metal material 102 into a predefined category. As one non-limiting example, the predefined categories for the metal material 102 may include 1xxx series aluminum alloys, 2xxx series aluminum alloys, 3xxx series aluminum alloys, 4xxx series aluminum alloys, 5xxx series aluminum alloys 6xxx series aluminum alloys, 7xxx series aluminum alloys, 8xxx series aluminum alloys, and/or non-aluminum metal. In various examples, the sensor 128 may be various sensors suitable for detecting material and classifying the detected material. In some cases, the sensor 128 may be a laser-induced breakdown spectroscopy sensor, an x-ray fluorescence sensor, an x-ray transmission sensor, a near-infrared spectroscopy sensor, and/or various other non-destructive sensor techniques or methods. In various examples, the separator 109 is selectively activated to apply the separating force 118 based on the detection and classification of the material on the conveying surface 107.

As illustrated in FIGS. 1 and 2, in some examples, the separator 109 includes a plurality of electromagnets 120A-H. Electromagnets are temporary magnets, meaning that they only retain their magnetism when an electrical current is running through them. Although eight electromagnets are illustrated in FIGS. 1 and 2, any number of electromagnets may be utilized as the separator including, but not limited to, one electromagnet (see FIG. 7), two electromagnets, three electromagnets, four electromagnets, five electromagnets, six electromagnets, seven electromagnets, eight electromagnets or more than eight electromagnets. While electromagnets 120A-H are illustrated, in other examples, other types of permanent magnets or temporary magnets, such as rotating or moving permanent magnets, may be used to provide a mobile magnetic field. In some examples, the electromagnets 120A-H are below the conveying surface 107, and a magnetic force of each electromagnet is a separating force 118 from that particular electromagnet.

Each electromagnet 120A-H is connected to a power source that supplies an electric current to the particular electromagnet 120A-H. While the electric current is supplied to the electromagnet 120, the electromagnet 120 creates the magnetic field as the separating force 118. As described previously, in some cases, the magnetic field is a changing magnetic field. The separating force 118 from the electromagnet 120 may lift particular materials off of the conveying surface 107 (e.g., the materials are vertically above the conveying surface 107). In certain examples, the separating force 118 may be applied to a particular piece of material without interacting with the stability of adjacent material on the conveyor belt 106. In some examples, the separating force 118 lifts the materials to a separated distance from the conveying surface 107. In certain non-limiting examples, the separated distance is from about 0.0 inches to about 12.0 inches, such as about 1.0 inch, about 2.0 inches, about 3.0 inches, about 4.0 inches, about 5.0 inches, about 6.0 inches, about 7.0 inches, about 8.0 inches, about 9.0 inches, about 10.0 inches, about 11.0 inches, and/or about 12.0 inches. In other examples, the separated distance between the material and the conveyor surface 107 is greater than 12.0 inches.

Optionally, the separating force 118 ejects the particular materials from the conveyor belt 106 (see FIG. 2). In such examples where the separating force 118 both lifts and ejects the material, the material may be ejected in a direction that is substantially parallel to the conveying direction 116. In other examples, the material may be ejected in a direction that is transverse to the conveying direction 116 (e.g., to the side(s) of the conveyor belt 106) (see FIG. 2).

When the electric current to the electromagnet is stopped, the separating force 118 disappears. By using electromagnets 120A-H as the separator 109, the separating force 118 can be quickly changed or adjusted to change or adjust the stability of the metal materials 102 on the conveyor belt 106. Exemplary techniques for adjusting the separating force 118 are described below and may be used individually or in any combination as desired. Such techniques may be performed by a controller 122 or manually by an operator.

In some examples, the magnetic field from one electromagnets 120 (and thus the separating force 118) is controlled by controlling an amount of flux provided to the electromagnet 120. Controlling the amount of flux includes, but is not limited to, controlling or adjusting a design of coils of the electromagnet 120, increasing or decreasing a frequency of the flux, increasing the amount of flux provided to the electromagnet 120 to increase the separating force 118, and/or decreasing the amount of flux provided to the electromagnet 120 to decrease the stabilizing force.

In some examples, adjusting the separating force 118 includes controlling a current supply time, which is the duration of time in which the current is supplied from the power source to the electromagnet 120. Because the separating force 118 is only present while the current is provided to the electromagnet 120, adjusting the current supply time adjusts the amount of time that the separating force 118 is applied to the metal material 102. In some examples, controlling the current supply time includes decreasing the current supply time to decrease the amount of time that the separating force 118 is applied to the metal material 102. In other examples, controlling the current supply time includes increasing the current supply time to increase the amount of time that separating force 118 is applied to the metal material 102.

In certain examples, adjusting the separating force 118 includes pulsing the current provided to the electromagnet 120. Pulsing the current may include alternating the amount of current provided in a regular or irregular pattern, alternating periods in which the current is activated or "on" and deactivated or "off" in a regular or irregular pattern, or other desired regular or irregular patterns where at least one aspect of the current is adjusted. In various examples, pulsing the current may provide various patterns of the separating force 118 onto the metal material 102. In some examples, adjusting the separating force 118 includes oscillation of the separating force 118. In various cases, adjusting the separating force 118 includes reversing the magnetic field. In some aspects, reversing the magnetic field includes changing the direction of flow of the electric current. In other examples, adjusting the separating force 118 includes controlling a vertical distance between the electromagnet 120 and the conveyor belt 106. In certain examples, adjusting the separating force 118 includes controlling an angular orientation of the electromagnet 120 (and thus an angle of the magnetic field) relative to the conveying surface 107. In various examples, adjusting the separating force 118 includes controlling a shape or angle of the electromagnet 120.

In various examples, each electromagnet is communicatively connected to the controller 122. In certain cases, the controller 122 independently controls each electromagnet 120A-H, although it need not in other examples. In certain examples, the controller 122 may control each electromagnet 120A-H based on a position and/or classification of metal material 102 (or other targeted materials) on the conveying surface 107 as determined by a sensor 128, or various other factors.

In some aspects, the separator 109 is controlled such that the separating force 118 from one electromagnet (e.g., electromagnet 120A) is different from the separating force 118 of another electromagnet (e.g., electromagnet 120B). In various examples, the separator 109 includes a first region along the conveyor belt 106 that includes a first subset of the plurality of electromagnets 120 and a second region along the conveyor belt 106 that includes a second subset of the plurality of electromagnets 120. In some optional examples, the electromagnets 120 in the first region may be selectively activated to apply the separating force 118 on a first type of material, and the electromagnets 120 in the second region may be selectively activated to apply the separating force 118 on a second type of material. As one non-limiting example, one or more of the electromagnets 120 in the first region may be selectively activated to apply the separating force 118 on a first type of metal material 102, such as a 1xxx series aluminum alloy, and one or more of the electromagnets 120 in the second region may be selectively activated to apply the separating force 118 on a second type of metal material 102, such as a 2xxx series aluminum alloy. FIG. 2 illustrates a non-limiting example where the electromagnets 120A, 120C, 120E, and 120G are a first set of electromagnets configured to lift and eject a first type of metal material 102 (e.g., a 2xxx series aluminum alloy) off of the conveyor belt 106 and into a first collecting area 124. In FIG. 2, the electromagnets 120B, 120D, 120F, and 120H are a second set of electromagnets configured to lift and eject a second type of metal material 102 (e.g., a 4xxx series aluminum alloy) off of the conveyor belt 106 and into a second collecting area 126. In other examples, various patterns of separating forces 118 may be applied onto the metal materials 102 by controlling the electromagnets 120. In the example of FIG. 2, electromagnets 120B and 120E are activated to eject the metal material 102 into the respective collecting areas 124, 126.

Figure 3:
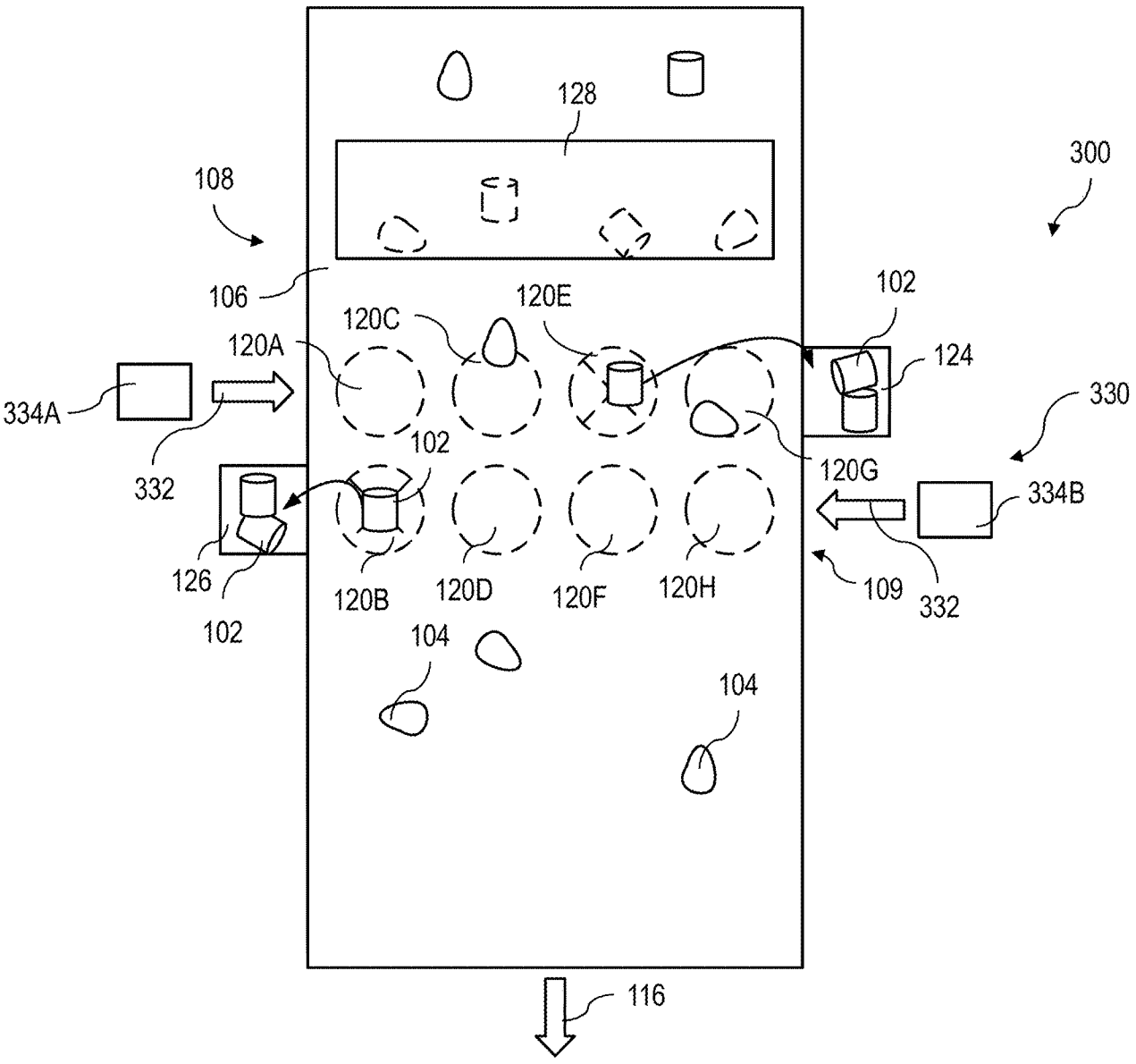
FIG. 3 is a top view of another conveyor system according to aspects of the current disclosure.

FIG. 3 illustrates another example of a conveyor system 300. The conveyor system 300 is substantially similar to the conveyor system 100 except that the separator 109 is a primary separator, and the separator system 108 includes a secondary separator 330. In various aspects, the secondary separator 330 is above the conveying surface 107, although it need not be in other examples. The secondary separator 330 is configured to apply a sorting force 332 onto the material after it has been lifted by the primary separator 109 through the separating force 118. The secondary separator 330 may be directly above the conveying surface 107 (see FIGS. 5 and 6) or may be offset to a side of the conveyor belt (see FIG. 3). In some examples, the separating force 332 assists with removing or ejecting the lifted material from the conveyor belt 106 after it has been lifted. The separating force 332 may be applied in a direction that is transverse to the conveying direction 116, although it need not be in other examples. In certain examples, the secondary separator 330 includes one or more airflow generators, such as air nozzles, and the sorting force 332 is airflow generated by the airflow generators. In other examples, the secondary separator 330 includes one or more magnets, such as electromagnets, and the sorting force 332 is a magnetic field generated by the electromagnets. In some examples, the secondary separator 330 includes one or more vacuum devices, and the sorting force 332 is a vacuum force generated by the vacuum devices. In various examples, the secondary separator 330 includes a conveyor belt having one or more magnets with a copper plate below the conveying surface of the conveyor belt, and the sorting force 332 is a magnetic field. In certain cases, the magnetic field is a changing magnetic field. Various other suitable secondary separators and sorting forces may be utilized.

In FIG. 3, the secondary separator 330 includes one or more electromagnets 334, and the sorting force 332 is the magnetic field generated by each electromagnet 334. In the example of FIG. 3, two electromagnets 334A-B are provided. The electromagnet 334A is configured to apply the sorting force 332 to the material that is lifted off of the conveying surface 107 by any one of electromagnets 120A, 120C, 120E, and/or 120G such that the material is directed into the first collecting area 124. Similarly, the electromagnet 334B is configured to apply the sorting force 332 to the material that is lifted off of the conveying surface 107 by any one of electromagnets 120B, 120D, 120F, and/or 120H such that the material is directed into the second collecting area 126.

Figure 4:
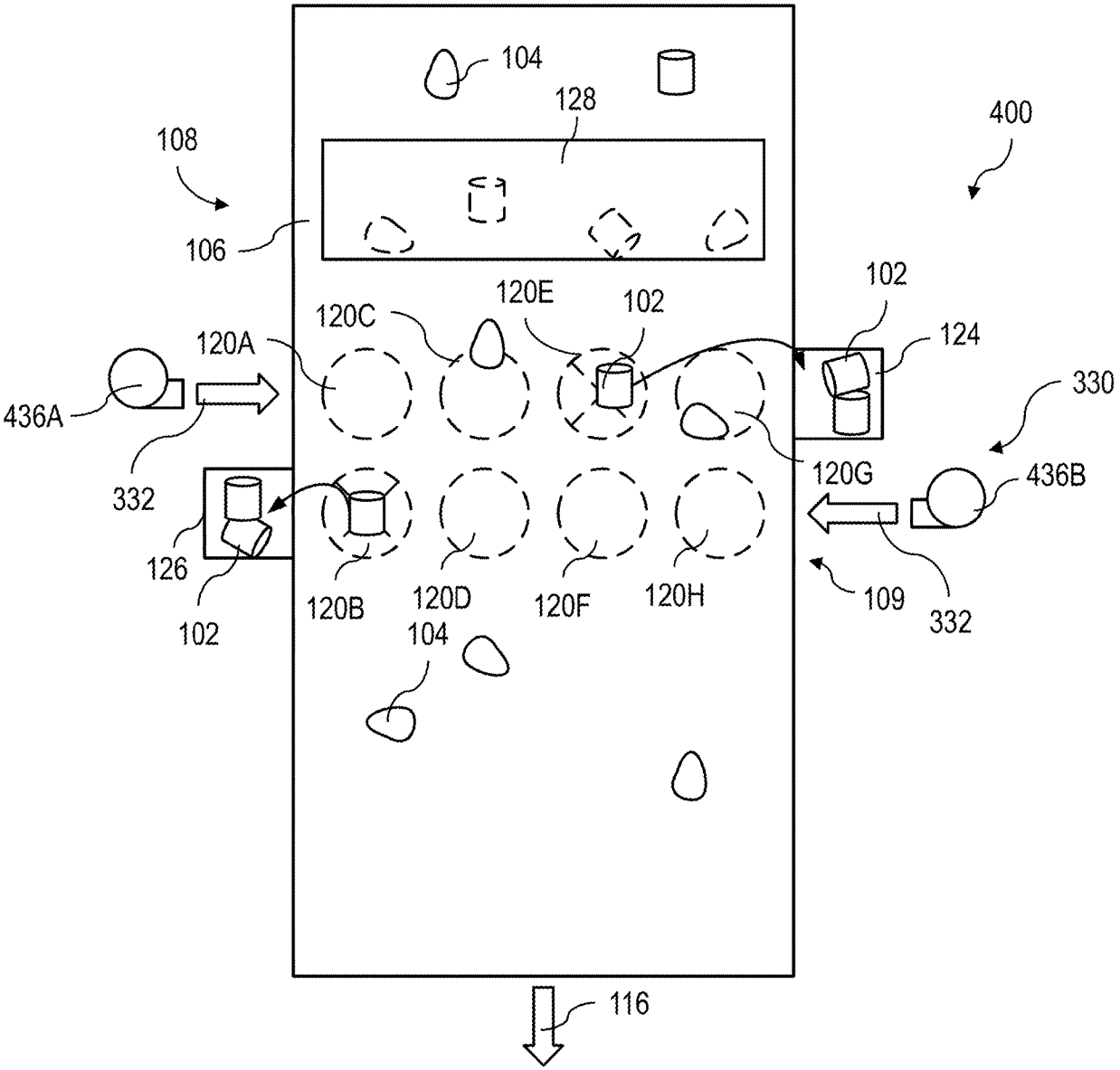
FIG. 4 is a top view of another conveyor system according to aspects of the current disclosure.

FIG. 4 illustrates another example of a conveyor system 400 that is substantially similar to the conveyor system 300 except that the secondary separator 330 includes one or more airflow generators 436, and the sorting force 332 is airflow generated by the airflow generators 436. In the example of FIG. 4, the secondary separator 330 includes two airflow generators 436A-B.

Figure 5:
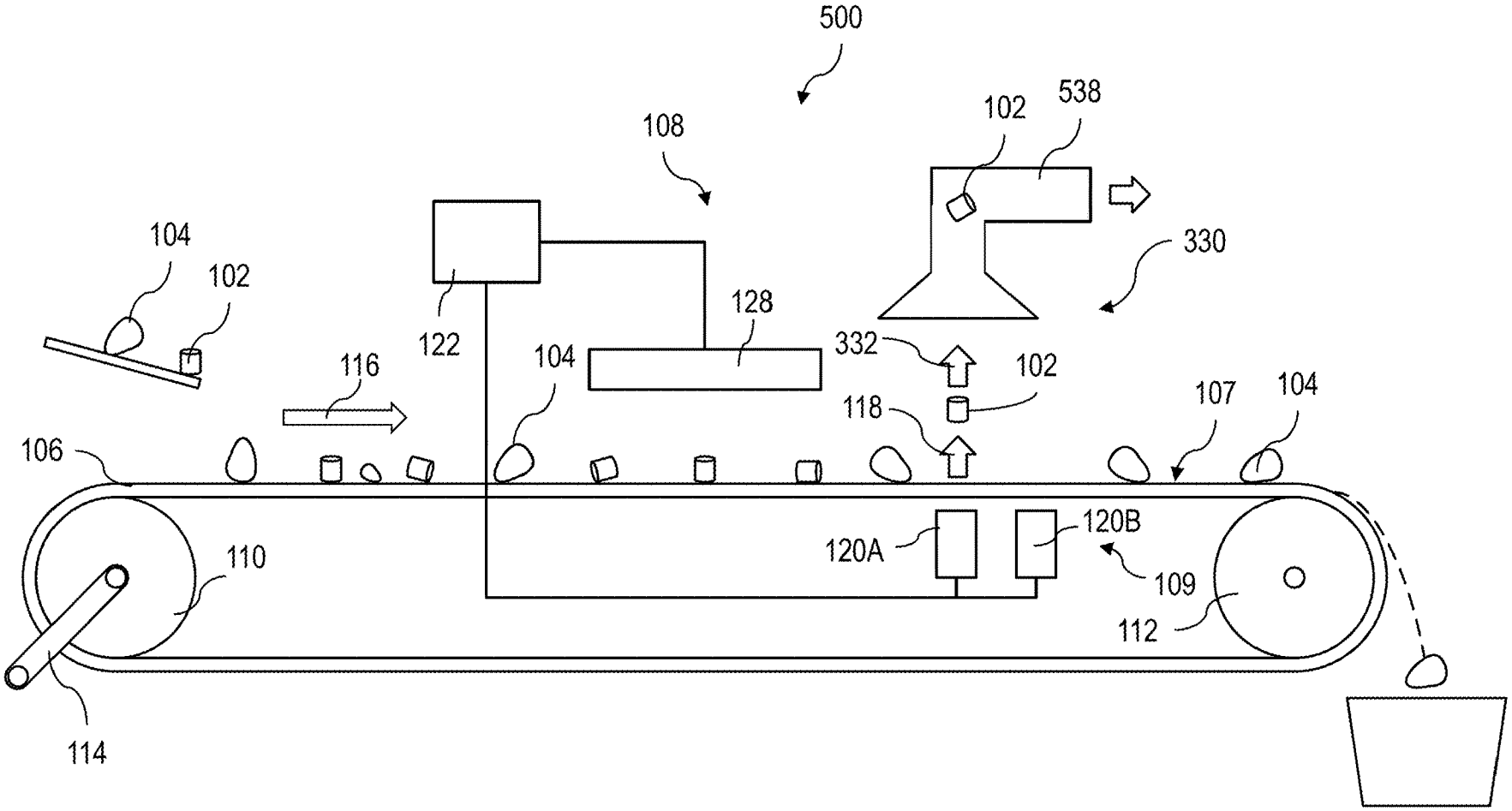
FIG. 5 is a side view of another conveyor system according to aspects of the current disclosure.

FIG. 5 illustrates another example of a conveyor system 500 that is substantially similar to the conveyor system 300 except that the secondary separator 330 includes one or more vacuum devices 538, and the sorting force 332 is a vacuum force generated by the vacuum device 538. In the example of FIG. 5, the secondary separator 330 includes one vacuum device 538, although more than one vacuum device 538 may be included in various other examples.

Figure 6:
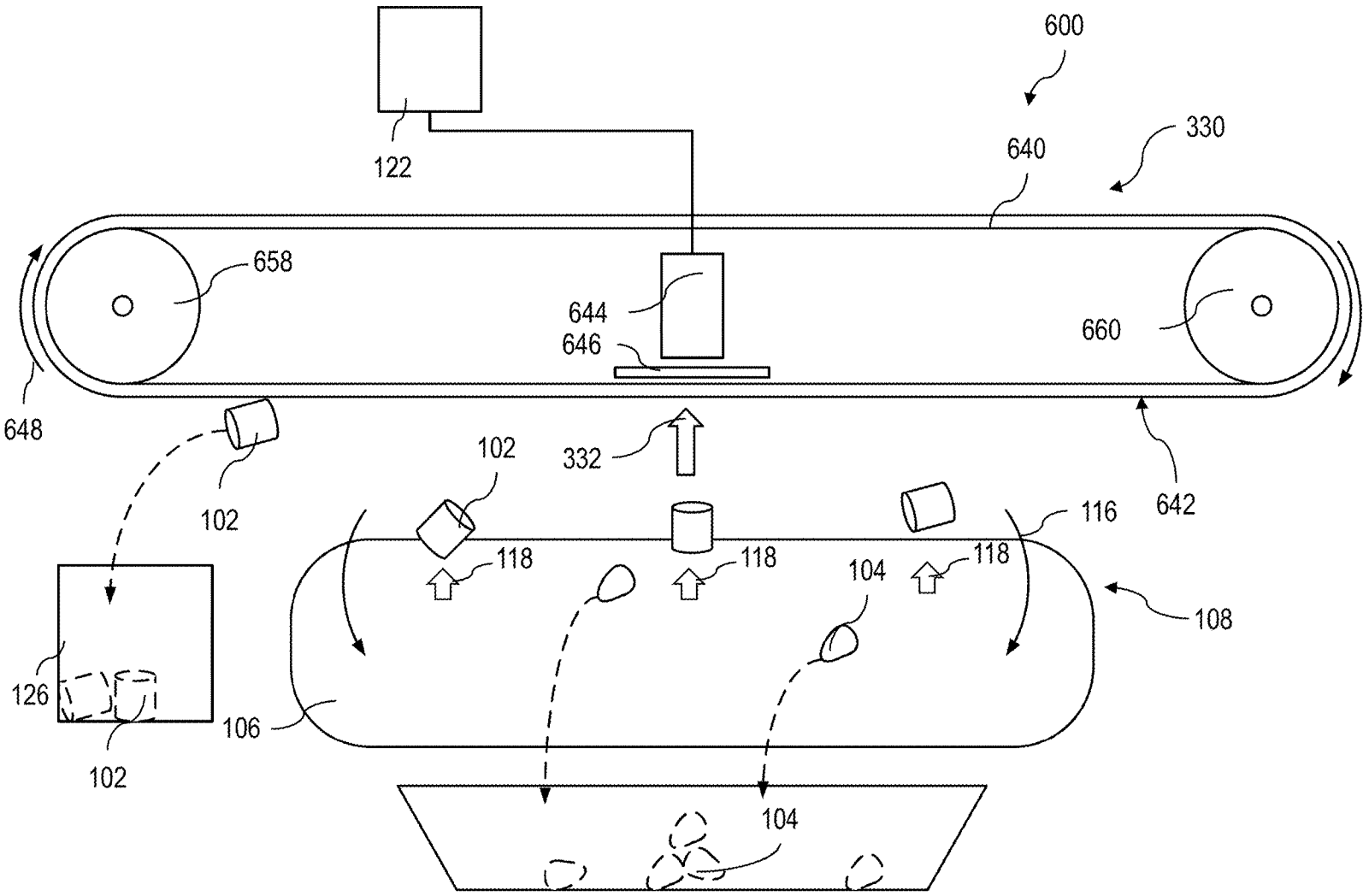
FIG. 6 is a front perspective view of another conveyor system according to aspects of the current disclosure.

FIG. 6 illustrates another example of a conveyor system 600 that is substantially similar to the conveyor system 300 except that the secondary separator 330 includes a secondary conveyor belt 640 that is substantially similar to the conveyor belt 106. The conveyor belt 640 includes a conveying surface 642. Similar to the conveyor belt 106, the secondary conveyor belt 640 is supported on at least two rollers 658, 660. In some examples, the conveyor belt 640 moves in a conveying direction 648 that is transverse to the conveying direction 116, although it need not be in other examples. The secondary separator 330 includes one or more electromagnets 644 below the conveying surface 642, and one or more copper plates 646 are provided between the electromagnets 644 and the conveying surface 642. In such examples, the material to be sorted such as the metal material 102 is initially lifted off of the conveyor belt 106 by the separating force 118 such that it engages the conveying surface 642, and the magnetic field of the electromagnets 644 (i.e., the sorting force 332) acts the copper plates 646 and the material on the conveying surface 642. The magnetic field acting on the copper plates 646 generates an attraction force as the sorting force 332 between the copper plates 646 and on the conveying surface 642 such that the material is retained on the conveying surface 642 as it is conveyed to a collecting area.

Figure 7:
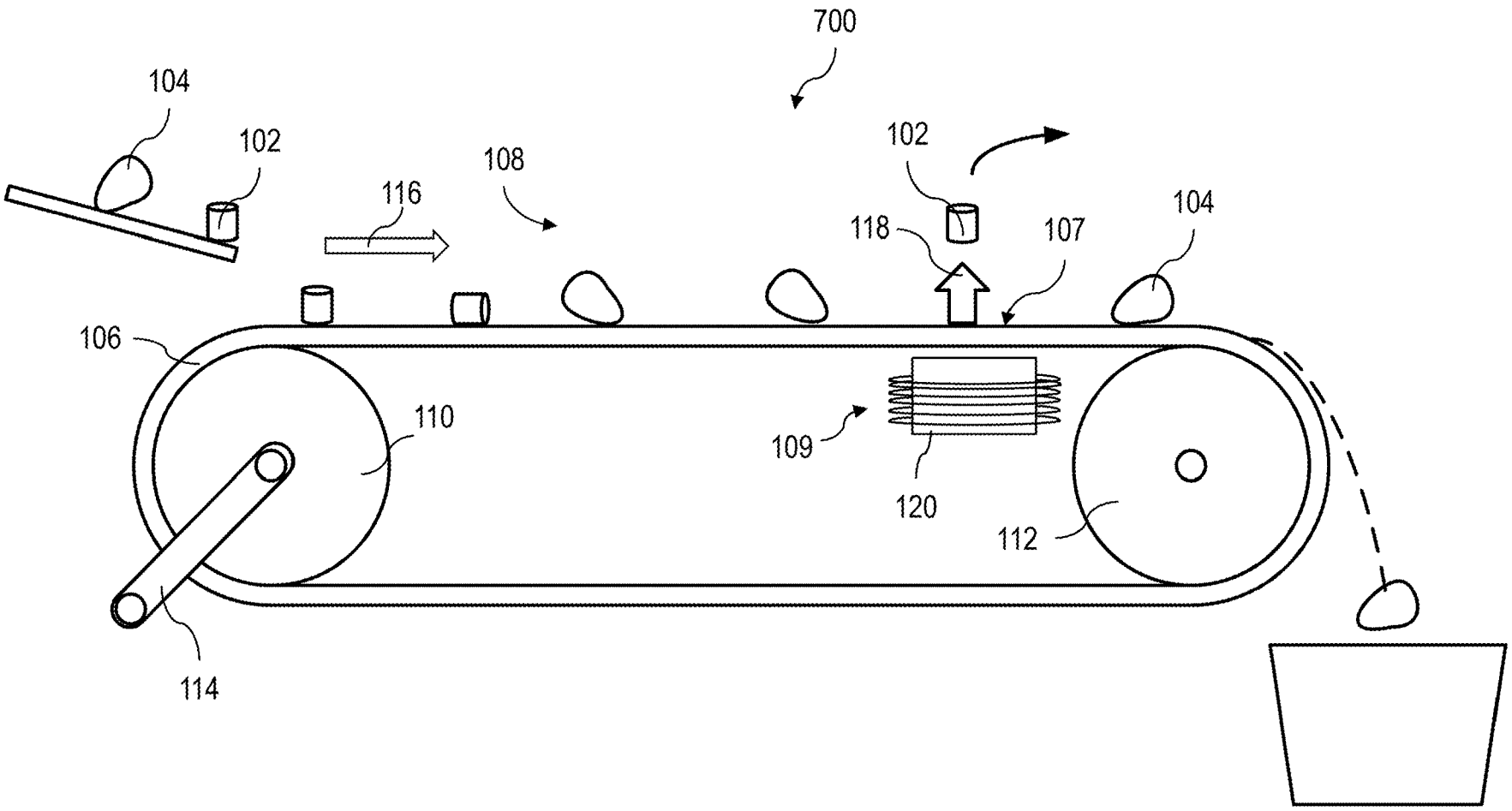
FIG. 7 is a side view of another conveyor system according to aspects of the current disclosure.

FIG. 7 illustrates another example of a conveyor system 700 that is substantially similar to the conveyor system 100 except that the separator 109 includes a single electromagnet 120.

Figure 8:
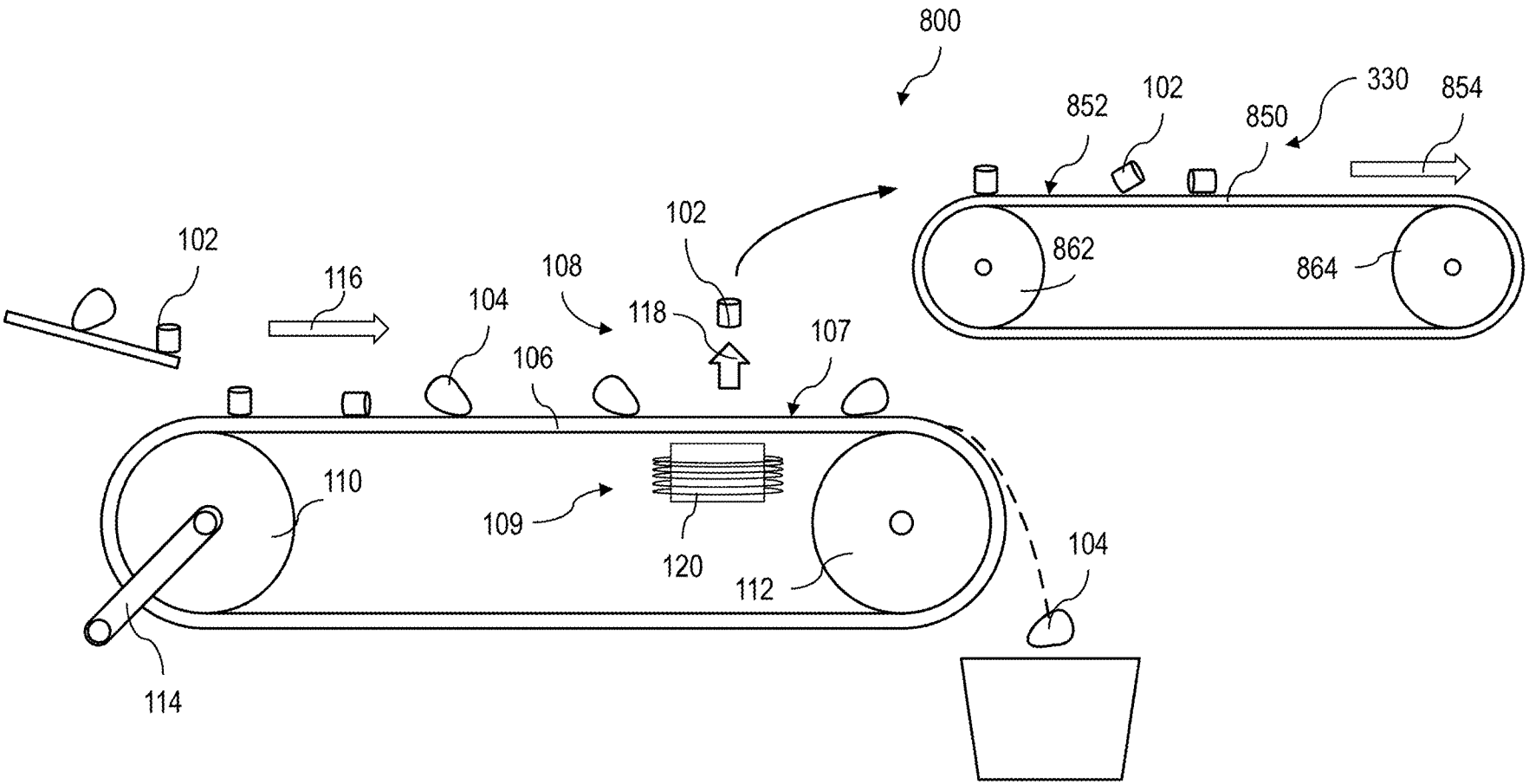
FIG. 8 is a side view of another conveyor system according to aspects of the current disclosure.

FIG. 8 illustrates another example of a conveyor system 800 that is substantially similar to the conveyor system 300 except that the separator 109 includes a single electromagnet 120 and the secondary separator 330 includes a conveyor belt 850 that is substantially similar to the conveyor belt 106. The conveyor belt 850 includes a conveying surface 852 and is supported on at least two rollers 862, 864. In this example, the conveyor belt 850 moves in a conveying direction 854 that is substantially parallel to the conveying direction 116 of the conveyor belt 106, although it need not in other examples.

Figure 9:
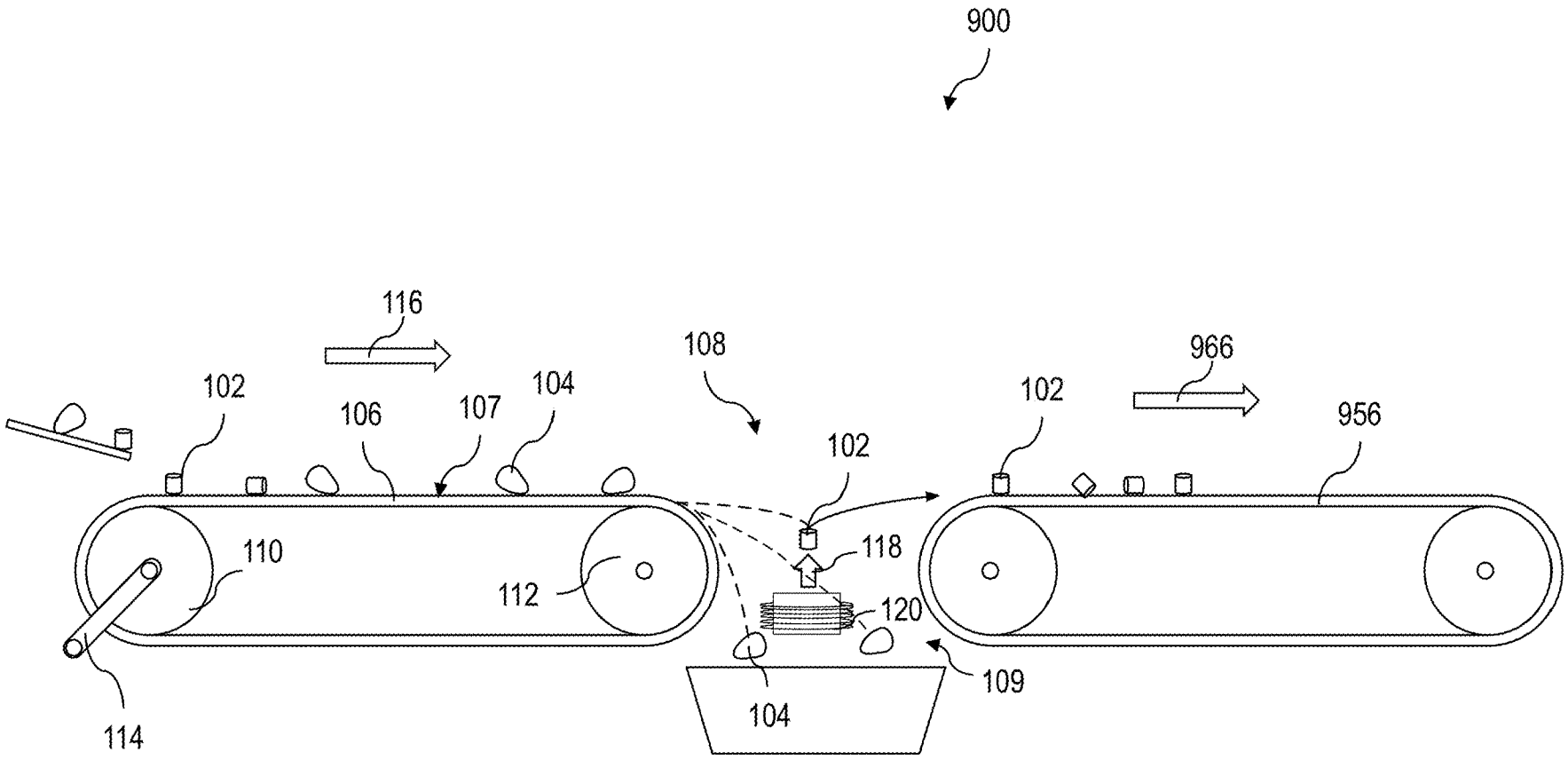
FIG. 9 is a side view of another conveyor system according to aspects of the current disclosure.

FIG. 9 illustrates another example of a conveyor system 900 that is substantially similar to the conveyor system 700 except that the separator 109 is downstream from the conveyor belt 106. In such examples, both the metal material 102 and the non-metal material 104 may leave the conveyor belt 106, and the metal material 102 is ejected onto another conveyor belt 956 (which may be substantially similar to the conveyor belt 106) moving in a conveying direction 966, another receiving area, etc. In certain examples, the separator 109 downstream from the conveyor belt 106 may allow for the metal material 102 to pass closer to the separator 109 and experience a stronger separating force 118.

Methods of sorting material on the conveyor belt 106 of a conveyor system are also disclosed. In some examples, the method includes receiving the material on a conveying surface of the conveyor belt and conveying the material with the conveyor belt. The method includes applying the separating force 118 onto the material with the separator 109 such that at least one piece of the material is lifted off of the conveying surface.

In certain examples, the separator 109 is initially in a deactivated state, and the method includes activating the separator 109 when a particular type of material is detected by the sensor 128. In some examples, the method includes controlling the separating force 118. In some examples where the separator 109 is a magnet, the method includes controlling the separating force 118 by controlling at least one of a strength of the magnetic field, a frequency of the magnetic field, or a direction of the magnetic field. In certain cases, the method includes detecting a position of a non-ferrous metal of the material on the conveying surface 107 before applying the separating force 118. In some cases, the method includes determining a classification of the non-ferrous metal before applying the separating force 118. In various cases, the separator 109 includes a plurality of electromagnets, and the method includes activating one of the plurality of electromagnets based on the position and classification of the detected non-ferrous metal.

A collection of exemplary examples, including at least some explicitly enumerated as "ECs" (Example Combinations), providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

EC 1. A conveyor system comprising: a conveyor belt comprising a conveying surface, wherein the conveyor belt is adapted to convey material on the conveying surface; and a separator system comprising a separator below the conveying surface, wherein the separator is configured to selectively apply a separating force onto the material on the conveyor belt such that at least one piece of the material is lifted off of the conveying surface.

EC 2. The conveyor system of any of the preceding or subsequent example combinations, further comprising a first roller and a second roller downstream from the first roller, wherein the conveyor belt is movably supported on the first roller and the second roller, and wherein the second roller is at an end of the conveyor belt.

EC 3. The conveyor system of any of the preceding or subsequent example combinations, wherein the separator is between the first roller and the second roller.

EC 4. The conveyor system of any of the preceding or subsequent example combinations, wherein the separator is downstream from the conveyor belt and is adjacent to the end of the conveyor belt.

EC 5. The conveyor system of any of the preceding or subsequent example combinations, wherein the separator is configured to apply the separating force onto non-ferrous metals of the material.

EC 6. The conveyor system of any of the preceding or subsequent example combinations, wherein the conveyor belt is porous.

EC 7. The conveyor system of any of the preceding or subsequent example combinations, wherein the separator system further comprises: a sensor; and a controller communicatively connected to the sensor and the separator, wherein the sensor is adapted to detect at least one piece of material of the material on the conveyor belt, wherein the controller is adapted to classify the detected piece of material into a predefined classification, and wherein the controller is adapted to selectively control the separating force from the separator based on the classification of the detected piece of material.

EC 8. The conveyor system of any of the preceding or subsequent example combinations, wherein the sensor comprises at least one of a laser-induced breakdown spectroscopy sensor, an x-ray fluorescence sensor, an x-ray transmitter sensor, or a near-infrared spectroscopy sensor.

EC 9. The conveyor system of any of the preceding or subsequent example combinations, wherein the separator is adapted to apply the separating force onto the material on the conveyor belt such that at least some of the material is lifted off of the conveying surface and in a direction substantially parallel to a conveying direction.

EC 10. The conveyor system of any of the preceding or subsequent example combinations, wherein the separator is adapted to apply the separating force onto the material on the conveyor belt such that at least some of the material is lifted off of the conveying surface in a direction transverse to a conveying direction.

EC 11. The conveyor system of any of the preceding or subsequent example combinations, wherein the separator is adapted to apply the separating force onto the material on the conveyor belt such that at least some of the material is lifted off of the conveying surface to a separated distance.

EC 12. The conveyor system of any of the preceding or subsequent example combinations, wherein the separated distance is from about 1 inch to about 12 inches.

EC 13. The conveyor system of any of the preceding or subsequent example combinations, wherein the separator comprises an electromagnet, and wherein the separating force is a changing magnetic field applied by the electromagnet.

EC 14. The conveyor system of any of the preceding or subsequent example combinations, wherein magnetic field is a changing magnetic field.

EC 15. The conveyor system of any of the preceding or subsequent example combinations, wherein the electromagnet is adjustable such that the magnetic field is adjustable.

EC 16. The conveyor system of any of the preceding or subsequent example combinations, wherein at least one of a strength of the magnetic field, a frequency of the magnetic field, or an angle of a central axis of the electromagnet with respect to the conveying surface are adjustable.

EC 17. The conveyor system of any of the preceding or subsequent example combinations, wherein the separator comprises a plurality of electromagnets and wherein the separating force is a magnetic field applied by each of the plurality of electromagnets.

EC. 18. The conveyor system of any of the preceding or subsequent example combinations, wherein magnetic field is a changing magnetic field.

EC 19. The conveyor system of any of the preceding or subsequent example combinations, wherein each of the plurality of electromagnets of the separator is independently controllable.

EC 20. The conveyor system of any of the preceding or subsequent example combinations, wherein the separator further comprises a first region comprising a first subset of the plurality of electromagnets and a second region comprising a second subset of the plurality of electromagnets, and wherein the magnetic field generated by at least one of the electromagnets of the first subset is different from the magnetic field generated by at least one of the electromagnets of the second subset.

EC 21. The conveyor system of any of the preceding or subsequent example combinations, further comprising: a sensor upstream from the separator; and a controller communicatively connected to the sensor and the separator, wherein the sensor is adapted to detect at least one piece of material of the material on the conveyor belt, wherein the controller is adapted to classify the detected piece of material into a predefined classification, and wherein the controller is adapted to selectively control the separating force from at least one of the electromagnets of the separator based on the classification of the detected piece of material.

EC 22. The conveyor system of any of the preceding or subsequent example combinations, further comprising a sensor configured to detect a position of at least one non-ferrous piece of metal of the material on the conveying surface, and wherein the controller is configured to control the separator based on the position of the at least one non-ferrous piece of metal on the conveying surface.

EC 23. The conveyor system of any of the preceding or subsequent example combinations, wherein the separator comprises a plurality of air nozzles arranged below the conveying surface, and wherein the separating force is airflow from each of the plurality of air nozzles.

EC 24. The conveyor system of any of the preceding or subsequent example combinations, wherein the separator is a primary separator, and wherein the separator system further comprises a secondary separator configured to apply a sorting force on the material lifted off of the conveying surface by the separating force.

EC 25. The conveyor system of any of the preceding or subsequent example combinations, wherein the secondary separator is above the conveying surface.

EC 26. The conveyor system of any of the preceding or subsequent example combinations, wherein the secondary separator comprises at least one vacuum, and wherein the separating force is a vacuum force.

EC 27. The conveyor system of any of the preceding or subsequent example combinations, wherein the secondary separator comprises at least one air nozzle, and wherein the separating force is airflow from the at least one air nozzle.

EC 28. The conveyor system of any of the preceding or subsequent example combinations, wherein the conveyor belt is a first conveyor belt, and wherein the secondary separator comprises: a second conveyor belt comprising a second conveying surface; at least one electromagnet beneath the second conveying surface; and a copper plate between the at least one electromagnet and the second conveying surface, wherein the separating force is a magnetic field from the at least one electromagnet and the copper plate.

EC 29. The conveyor system of any of the preceding or subsequent example combinations, wherein the second conveyor belt extends transversely to the first conveyor belt.

EC 30. The conveyor system of any of the preceding or subsequent example combinations, wherein the second conveying surface faces the conveying surface of the first conveyor belt.

EC 31. The conveyor system of any of the preceding or subsequent example combinations, wherein the secondary separator is adapted to apply the sorting force in a direction transverse to a conveying direction.

EC 32. The conveyor system of any of the preceding or subsequent example combinations, wherein the conveyor belt is a first conveyor belt, wherein the conveying system further comprises a second conveyor belt, and wherein the separator is configured to selectively apply the separating force onto the material on the conveyor belt such that at least one piece of the material is lifted off of the conveying surface of the first conveyor belt and onto the second conveyor belt.

EC 33. A method of sorting material on a conveyor belt comprising: receiving the material on a conveying surface of the conveyor belt; conveying the material with the conveyor belt; and applying a separating force onto the material with a separator arranged below the conveying surface such that at least one piece of the material is lifted off of the conveying surface.

EC 34. The method of any of the preceding or subsequent example combinations, wherein at least some of the material comprises non-ferrous metal, and wherein the separating force is applied on the non-ferrous metal.

EC 35. The method of any of the preceding or subsequent example combinations, wherein the separator comprises at least one electromagnet, and wherein the separating force comprises a magnetic field.

EC 36. The method of any of the preceding or subsequent example combinations, further comprising controlling the magnetic field by controlling at least one of a strength of the magnetic field, a frequency of the magnetic field, or a direction of the magnetic field.

EC 37. The method of any of the preceding or subsequent example combinations, further comprising detecting a position of a non-ferrous metal of the material on the conveying surface before applying the separating force.

EC 38. The method of any of the preceding or subsequent example combinations, wherein applying the separating force comprises applying the separating force at the position on the conveying surface corresponding to the detected position of the non-ferrous metal.

EC 39. The method of any of the preceding or subsequent example combinations, wherein the separator is a primary separator, and wherein the method further comprises applying a sorting force by a secondary separator on the material lifted off of the conveying surface by the separating force.

EC 40. The method of any of the preceding or subsequent example combinations, wherein the secondary separator is adapted to apply the sorting force in a direction transverse to a conveying direction.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A conveyor system comprising:

a conveyor belt comprising a conveying surface, wherein the conveyor belt is adapted to convey material on the conveying surface;

a separator system comprising a separator below the conveying surface, wherein the separator is configured to apply a separating force onto the material on the conveyor belt such that at least one piece of the material is lifted off of the conveying surface, wherein the separator comprises a plurality of magnetic sources, and wherein the separating force is a magnetic field applied by each of the plurality of magnetic sources;

a sensor upstream from the separator; and a controller communicatively connected to the sensor and the separator, wherein the sensor is adapted to detect at least one piece of material of the material on the conveyor belt, wherein the controller is adapted to classify the detected piece of material into a predefined classification, and wherein the controller is adapted to selectively control the separating force from at least one of the magnetic sources of the separator based on the classification of the detected piece of material.

2. The conveyor system of claim 1, further comprising:

a first roller; and a second roller downstream from the first roller, wherein the conveyor belt is movably supported on the first roller and the second roller, wherein the second roller is at an end of the conveyor belt, and wherein the separator is between the first roller and the second roller.

3. The conveyor system of claim 1, wherein the separator is configured to apply the separating force onto non-ferrous metals of the material.

4. The conveyor system of claim 1, wherein the sensor comprises at least one of a laser-induced breakdown spectroscopy sensor, an x-ray fluorescence sensor, an x-ray transmitter sensor or a near-infrared spectroscopy sensor.

5. The conveyor system of claim 1, wherein the separator is adapted to apply the separating force onto the material on the conveyor belt such that at least some of the material is lifted off of the conveying surface and in a direction substantially parallel to a conveying direction.

6. The conveyor system of claim 1, wherein the separator is adapted to apply the separating force onto the material on the conveyor belt such that at least some of the material is lifted off of the conveying surface in a direction transverse to a conveying direction.

7. The conveyor system of claim 1, wherein the separator is adapted to apply the separating force onto the material on the conveyor belt such that at least some of the material is lifted off of the conveying surface to a separated distance, and wherein the separated distance is greater than 0 inches.

8. The conveyor system of claim 1, wherein the plurality of magnetic sources of the separator comprises a plurality of electromagnets, and wherein the separating force is a magnetic field applied by each of the plurality of electromagnets.

9. The conveyor system of claim 8, wherein the separator further comprises a first region comprising a first subset of the plurality of electromagnets and a second region comprising a second subset of the plurality of electromagnets, and wherein the magnetic field generated by at least one of the electromagnets of the first subset is different from the magnetic field generated by at least one of the electromagnets of the second subset.

10. The conveyor system of claim 1, further comprising a sensor configured to detect a position of at least one non-ferrous piece of metal of the material on the conveying surface, and wherein the controller is configured to control the separator based on the position of the at least one non-ferrous piece of metal on the conveying surface.

11. The conveyor system of claim 1, wherein the separator is a primary separator, and wherein the separator system further comprises a secondary separator configured to apply a sorting force on the material lifted off of the conveying surface by the separating force.

12. A method of sorting material on a conveyor belt comprising:

receiving the material on a conveying surface of the conveyor belt;

conveying the material with the conveyor belt;

detecting at least one piece of material of the material on the conveyor belt with a sensor;

classifying, using a controller, the detected piece of material into a predefined classification applying a separating force onto the material with a separator arranged below the conveying surface such that at least one piece of the material is lifted off of the conveying surface, wherein the separator comprises a plurality of magnetic sources, and wherein the separating force is a magnetic field applied by each of the plurality of magnetic sources, and wherein applying the separating force comprises selectively control the separating force from at least one of the magnetic sources of the separator based on the classification of the detected piece of material.

13. The method of claim 12, wherein at least some of the material comprises non-ferrous metal, and wherein the separating force is applied on the non-ferrous metal.

14. The method of claim 12, wherein the plurality of magnetic sources of the separator comprises at least one electromagnet, and wherein the method further comprises controlling the magnetic field by controlling at least one of a strength of the magnetic field, a frequency of the magnetic field, or a direction of the magnetic field.

15. The method of claim 12, further comprising detecting a position of a non-ferrous metal of the material on the conveying surface before applying the separating force.

16. The method of claim 15, wherein applying the separating force comprises applying the separating force at the position on the conveying surface corresponding to the detected position of the non-ferrous metal.

17. The method of claim 12, wherein the separator is a primary separator, and wherein the method further comprises applying a sorting force by a secondary separator on the material lifted off of the conveying surface by the separating force.

18. The method of claim 17, wherein the secondary separator is adapted to apply the sorting force in a direction transverse to a conveying direction.

* * * * *